United States Patent [19]

Brody

[11] Patent Number: 4,522,884

[45] **Date of Patent: * Jun. 11, 1985**

[54] PROCESS OF MELT SPINNING POLYPROPYLENE AND NOVEL ROUGH SURFACED FIBRES PRODUCED THEREBY

[75] Inventor: Harry Brody, Harrogate, England

[73] Assignee: Imperial Chemical Industries PLC, Hertfordshire, England

[ * ] Notice: The portion of the term of this patent subsequent to Apr. 10, 2001 has been disclaimed.

[21] Appl. No.: 365,024

[22] Filed: Apr. 2, 1982

Related U.S. Application Data

[63] Continuation-in-part of Ser. No. 268,252, May 29, 1981, Pat. No. 4,442,266.

[30] Foreign Application Priority Data

May 13, 1981 [GB] United Kingdom ..... 8114626
Mar. 19, 1982 [EP] European Pat. Off. ..... 82301422.0

[51] Int. Cl.[3] ..... D02G 3/00

[52] U.S. Cl. ..... 428/400; 428/364; 428/372

[58] Field of Search ..... 428/372, 400, 364; 524/27, 35, 37; 528/191; 525/425, 444

[56] References Cited

U.S. PATENT DOCUMENTS

| | | | |
|---|---|---|---|
| 3,991,013 | 11/1976 | Pletcher | 528/191 |
| 4,356,234 | 10/1982 | Kumakawa et al. | 428/372 |
| 4,386,174 | 5/1983 | Cogswell | 524/27 |

FOREIGN PATENT DOCUMENTS

| | | |
|---|---|---|
| 0041327 | 5/1981 | European Pat. Off. . |
| 2008598 | 6/1979 | United Kingdom . |

*Primary Examiner*—Lorraine T. Kendell
*Attorney, Agent, or Firm*—Cushman, Darby & Cushman

[57] ABSTRACT

A process of melt spinning polypropylene with a wind up speed of less than 1000 meters per minute in which there is added to the polypropylene a small proportion of a polymer capable of forming an anisotropic melt in the temperature range at which the polypropylene may be melt spun and novel rough surface fibres of polypropylene containing between 0.1% and 10% by weight of the aforementioned polymer.

4 Claims, 5 Drawing Figures

PROCESS OF MELT SPINNING POLYPROPYLENE AND NOVEL ROUGH SURFACED FIBRES PRODUCED THEREBY

This application is continuation-in-part of application Ser. No. 268,252 filed May 29, 1981, now U.S. Pat. No. 4,442,266.

This invention relates to a process for manufacturing fibres of polypropylene by melt spinning. One advantage of the process is that it allows significant productivity gains to be achieved.

Another advantage is that novel fibres of polypropylene are produced having a rough surface. Fibres of polypropylene produced by extrusion through fine orifices by the melt spinning technique normally possess a smooth shiny surface. Although the cross section of the filamentary fibres may be other than circular, fabrics made from such fibres possess a slick hand and are cold to the touch. In addition if the fibres are made into staple fibres, the smooth surface makes for more difficult working of the staple fibres into spun yarn. The desired fibre cohesiveness is not available. Natural fibres such as wool and cotton have a rough surface, which tends to interlock in the spun yarn. The rough surface also provides better heat insulation and lends a warm-to-the-touch quality to fabrics made from such yarn.

Attempts have been made to provide polypropylene fibres with a rough surface by either incorporating a particulate filler such as talc, finely powdered fibrous material, metal whiskers, alumina or silica carbide, silica, or a blowing agent in the polypropylene before it is spun or by rapidly cooling the fibres with water or solvent. The process of the invention provides fibres of polypropylene having a rough surface without recourse to such techniques.

According to the invention, therefore, we provide fibres of polypropylene having a rough surface containing a small proportion of a polymer capable of forming an anisotropic melt in the temperature range at which polypropylene may be melt spun.

We also provide a process of melt spinning polypropylene in which there is added to the polypropylene a small proportion of a polymer capable of forming an anisotropic melt in the temperature range at which the polypropylene may be melt spun, and the polymers are then melt spun together in intimate mixture at a wind up speed of less than 1000 metres per minute. In such a process there is a suppression of wind up speed compared with the process carried out in the absence of the added polymer. Furthermore the fibres of polypropylene produced by the process have a novel rough surface as referred to above.

We prefer that the overlap of the anisotropic melt temperature range of the added polymer and the spinnable temperature range of the polypropylene is at least 5° C. and preferably much more and we prefer to incorporate between 0.1% and 10% by weight of the added polymer.

By "a polymer capable of forming an anisotropic melt" is meant either that the polymer forms such a melt when heated to a particular temperature range, characteristic of the polymer (this type is termed a "thermotropic" polymer) or can be induced to form such a melt by the application of shear to the melt. The latter state is characterised by the persistence of the anisotropic condition for a period of a second or two after the melt ceases to be sheared. This distinguishes it from the well-known observation that, for example, a polyethylene terephthalate melt will exhibit order when sheared by passing the melt through a tube. Such order disappears immediately the melt ceases to be sheared. Some polymers may show both thermotropic and shear-induced anisotropy. Polymers exhibition such anisotropic melt behaviour have been called liquid crystal polymers and in what follows will be referred to as LC polymers. Polypropylene will be referred to as the host polymer. Some tests for establishing whether a polymer shows anisotropic melt behaviour have been published in British Pat. No. 1 507 207.

Many patent specifications were published during the 1970's disclosing LC polymers. In general any known LC polymer can be chosen for addition to the host polymer according to the invention provided that it can be processed in the same melt temperature range as the host polymer and provided that it does not react chemically with the host polymer to cause significant polymer degradation during melt spinning.

For use with polypropylene as the host polymer particularly suitable LC polymers are copoly chloro 1,4 phenylene ethylene dioxy 4,4' dibenzoate/terephthalate (CLOTH) and copoly ethylene terephthalate/p-oxybenzoate (designated X7G in the following examples).

The effect of LC polymers is that of surface roughness of the spun fibre and of WUS suppression i.e. the properties of the spun fibre are those that would be obtained from a fibre spun at lower WUS. As the WUS increases in normal spinning where LC polymers are not used certain properties of fibres increase or decrease continuously. These properties can therefore be used to measure the degree of WUS suppression. In the case of polypropylene, the property that has been chosen has been the true stress at 50% strain derived from the Instron stress/strain curve of the spun fibre. This normally increases smoothly with WUS, so that a reduction of this stress at a given WUS is indicative of WUS suppression.

DETAILED DESCRIPTION

Figure 1:
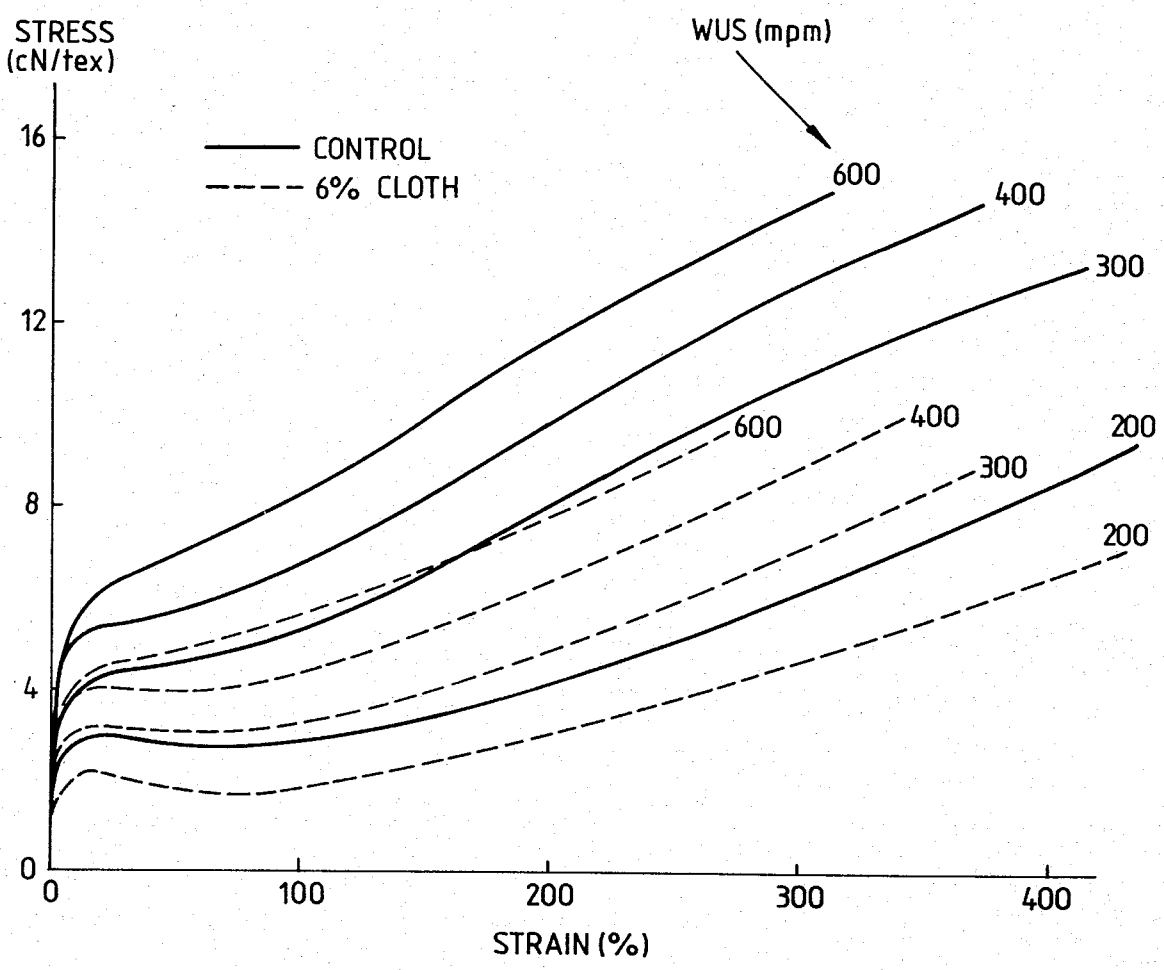
FIG. 1 is a graph of stress versus strain for polypropylene fibres.

This invention will now be described with reference to the following Examples:

In the experiments described below two different LC polymers were mixed with polypropylene as host polymer. The LC polymers were:

(In Example 1) Copoly chloro 1,4 phenylene ethylene dioxy 4,4' dibenzoate/terephthalate (CLOTH). This polymer was prepared according to Example 3 of U.S. Pat. No. 3,991,013. It had an inherent viscosity of 1.07 dl/g at 25° C. in a 1% solution of dichloroacetic acid. The polymer gave an anisotropic melt at 188° C. It had a melt viscosity of 220 $Ns/m^2$ at $10^4$ $N/m^2$ and 270° C. The above LC polymers were blended separately in the weight concentrations mentioned below with Ulstron grade polypropylene containing pro-degradant in a BETOL single screw extruder which had a 19 mm diameter 'nylon screw' of 30:1 L/D ratio. The screw feed was 100 rpm with the feed zone at 210° C. and observed barrel temperatures from feed zone to die end of 225°, 270°, 275° and 280° C. The blend leaving the die had a temperature of 260°–265° C. The lace was 2 mm diameter and water quenched, with a slight haul-off to give smooth running. It was then cut with a lace cutter.

The LC polymers were all dried overnight in a vacuum oven at 60°–70° C. before blending. The polypropylene was not pre-dried. Mix weights of about 700 grams were fed to the extruder and about the first 200 grams dumped to clear out the previous 'tail'.

As a control, polypropylene without addition of LC polymer, was also passed through the extruder.

The blends so formed were spun on a rod spinner through 15 thou spinneret holes without quench air or a conditioner tube. Candles were made at 135° C. with 8 minutes candling time. The throughput was 27 g/hr/hole and the extrusion temperature finally selected after various trials was 288° C. Spin finish was applied in a conventional manner. The yarn was wound on a conventional wind-up unit for wind up speeds (WUS) up to 600 mpm, while a capstan was used for WUS greater than 600 mpm and the yarn rewound onto bobbins.

It was found that stress-strain curves offer a satisfactory basis for comparing products obtained from blends of an LC polymer and polypropylene with the control. In general the stress at a given strain increases fairly uniformly and so the true stress at a fixed strain of 50% provides a good basis for evaluating the degree of wind up speed suppression.

The results obtained are tabulated in Table 1.

Figure 2:
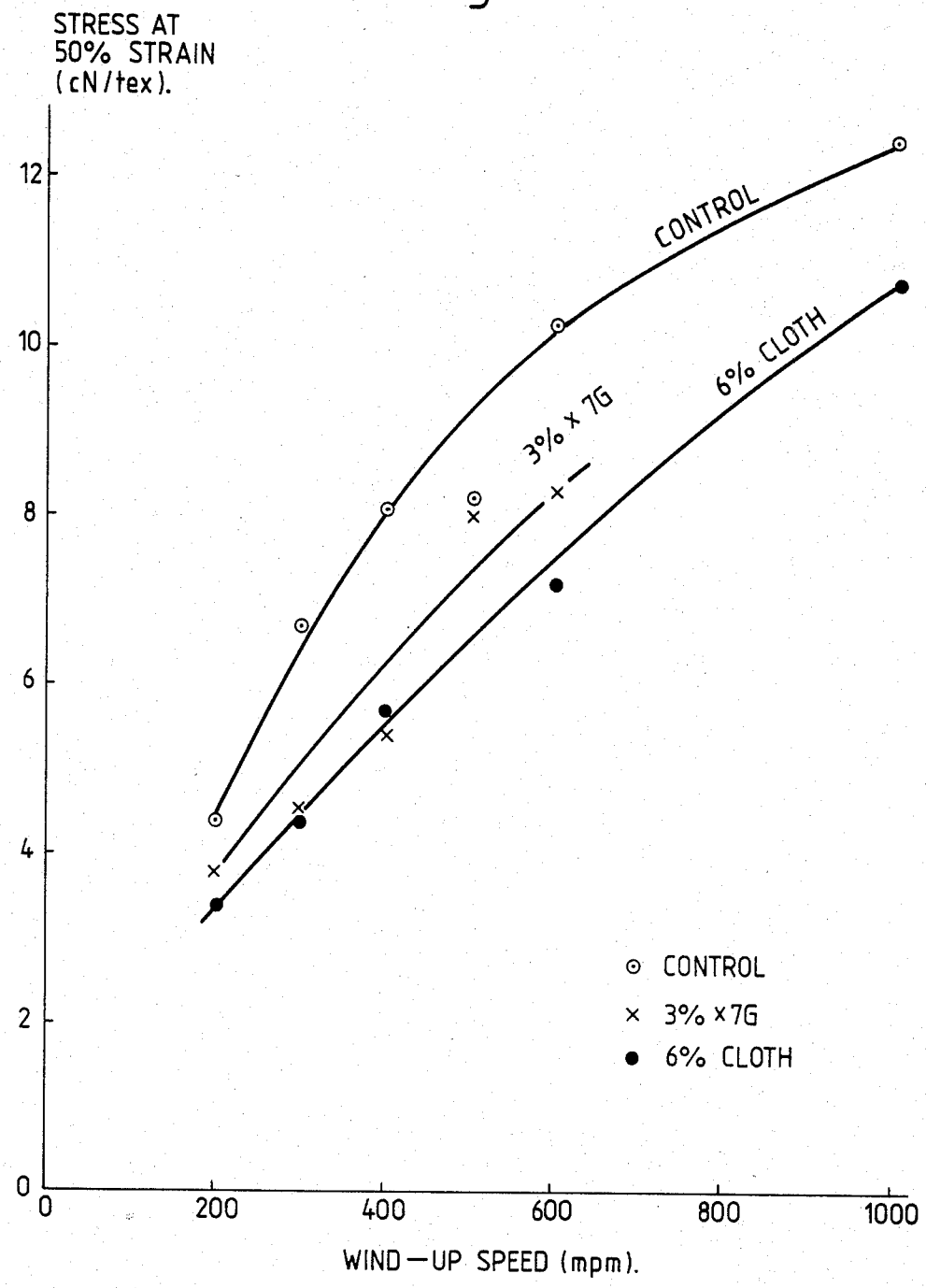
FIG. 2 is a graph of stress versus wind-up speed for polypropylene fibres.

FIG. 1 also shows the effect of 6% by weight of CLOTH on the stress-strain curves of polypropylene. FIG. 2 further shows the effect of both 6% CLOTH and 3% X7G (both by weight) on the stress curves of polypropylene at various WUS. (In FIG. 1 it should be noted that the stress is not a true stress but is the 'specific stress', i.e. the load divided by the initial tex).

TABLE 1

| BLEND | WUS (mpm) | TRUE STRESS AT 50% STRAIN (cN/TEX) | EQUIVALENT LOWER WUS* (mpm) |
|---|---|---|---|
| CONTROL | 200 | 4.4 | |
| | 300 | 6.7 | |
| | 400 | 8.1 | |
| | 500 | 8.2 | |
| | 600 | 10.4 | |

TABLE 1-continued

| BLEND | WUS (mpm) | TRUE STRESS AT 50% STRAIN (cN/TEX) | EQUIVALENT LOWER WUS* (mpm) |
|---|---|---|---|
| | 1000 | 12.5 | |
| 6% CLOTH | 200 | 3.4 | |
| | 300 | 4.4 | 200 |
| | 400 | 5.7 | 250 |
| | 600 | 7.2 | 360 |
| | 1000 | 10.8 | 675 |
| 3% X7G | 200 | 3.8 | |
| | 300 | 4.5 | 225 |
| | 400 | 5.4 | 280 |
| | 500 | 8.1 | 350 |
| | 600 | 8.3 | 425 |

*calculated from curves in FIG. 2.

The effect of the LC polymers was appreciable with 6% CLOTH producing almost 1 50% fall in effective WUS.

Table 2 shows that the melt flow index (MFI) of the fibres containing an LC polymer were essentially the same as the control, within experimental error, so that the effect is not due to the degradation of the polypropylene.

TABLE 2

| | BLEND | MFI | MOLECULAR WEIGHT |
|---|---|---|---|
| CHIP | CONTROL | 66 | 212,000 |
| | 6% CLOTH | 94 | 192,000 |
| FIBRE | CONTROL | 120 | 179,000 |
| | 3% X7G | 184 | 159,000 |
| | 6% CLOTH | 140 | 171,000 |

Figure 3:
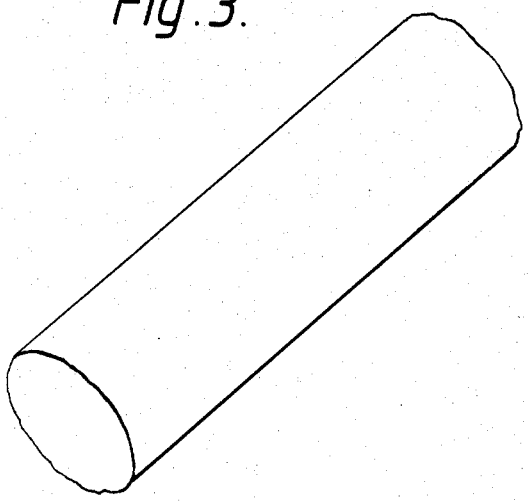
FIG. 3 is a perspective view of a smooth-surfaced polypropylene fibre.
Figure 4:
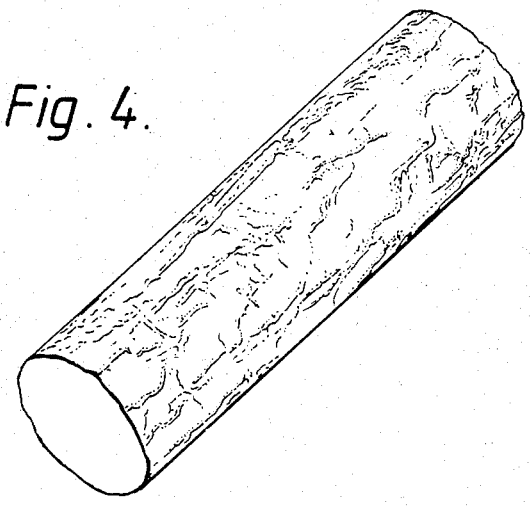
FIGS. 4 and 5 are perspective views of rough-surfaced polypropylene fibres.
Figure 5:
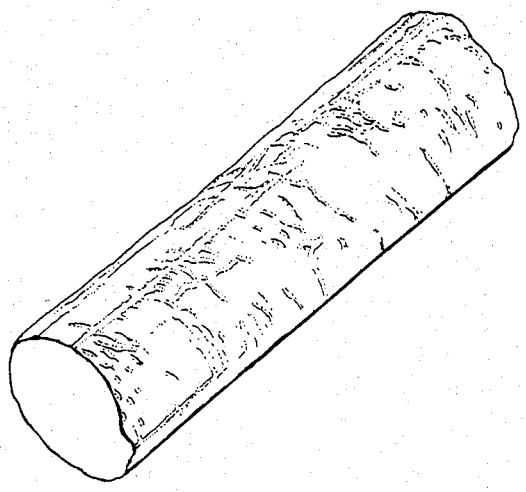

From the accompanying drawings it will be seen that fibres produced as a control (FIG. 3) have a smooth surface. In contrast fibres containing 6% CLOTH (FIG. 4) and 3% X7G (FIG. 5) have a rough surface which offers advantages from both a technical and aesthetic point of view.

I claim:

1. Fibres of polypropylene having a rough surface containing a small proportion of a polymer capable of forming an anisotropic melt in the temperature range at which polypropylene may be melt spun.

2. Fibres of polypropylene having a rough surface as claimed in claim 1 containing between 0.1% and 10% by weight of the polymer.

3. Fibres of polypropylene having a rough surface as claimed in either claim 1 or claim 2 containing copoly chloro 1,4 phenylene ethylene dioxy 4,4' dibenzoate/-terephthalate.

4. Fibres of polypropylene having a rough surface as claimed in either claim 1 or claim 2 containing copoly ethylene terephthalate/p-oxybenzoate.

* * * * *